US011345146B2

(12) United States Patent
Sugiura et al.

(10) Patent No.: US 11,345,146 B2
(45) Date of Patent: May 31, 2022

(54) LIQUID DISCHARGE HEAD

(71) Applicant: Brother Kogyo Kabushiki Kaisha, Nagoya (JP)

(72) Inventors: Keita Sugiura, Toyokawa (JP); Shohei Koide, Nagoya (JP); Keita Hirai, Nagoya (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/849,577

(22) Filed: Apr. 15, 2020

(65) Prior Publication Data

US 2020/0384759 A1 Dec. 10, 2020

(30) Foreign Application Priority Data

Jun. 5, 2019 (JP) ..... JP2019-105488

(51) Int. Cl.
*B41J 2/045* (2006.01)
*B41J 2/14* (2006.01)

(52) U.S. Cl.
CPC ..... *B41J 2/04563* (2013.01); *B41J 2/04586* (2013.01); *B41J 2/1433* (2013.01); *B41J 2002/14419* (2013.01)

(58) Field of Classification Search
CPC ..... B41J 2202/12
See application file for complete search history.

(56) References Cited

U.S. PATENT DOCUMENTS

2010/0134571 A1* 6/2010 Shimizu ..... B41J 2/17596 347/85
2010/0165023 A1* 7/2010 Suzuki ..... B41J 2/18 347/10
2011/0221820 A1* 9/2011 Shibata ..... B41J 2/0458 347/17
2019/0092003 A1* 3/2019 Mizuno ..... B41J 2/155
2020/0398560 A1* 12/2020 Tsuneoka ..... B41J 2/0456

FOREIGN PATENT DOCUMENTS

JP 2008-290292 A 12/2008
JP 2017-177758 A 10/2017

* cited by examiner

*Primary Examiner* — Shelby L Fidler
(74) *Attorney, Agent, or Firm* — Banner & Witcoff, Ltd.

(57) ABSTRACT

There is provided a liquid discharge head including a channel member and a temperature sensor. The channel member includes: a plurality of individual channels aligned in a first direction; a first common channel extending in the first direction and communicating with the plurality of individual channels; a second common channel extending in the first direction, communicating with the plurality of individual channels and arranged side by side to the first common channel in a second direction crossing the first direction; and a connecting channel extending in the second direction and connecting an end in the first direction of the first common channel and an end in the first direction of the second common channel. The temperature sensor overlaps with the connecting channel in the second direction.

14 Claims, 8 Drawing Sheets

LIQUID DISCHARGE HEAD

CROSS REFERENCE TO RELATED APPLICATION

The present application claims priority from Japanese Patent Application No. 2019-105488, filed on Jun. 5, 2019, the disclosure of which is incorporated herein by reference in its entirety.

BACKGROUND

Field of the Invention

The present disclosure relates to a liquid discharge head provided with a first common channel, a second common channel and a connecting channel (linking channel) connecting (linking) the first common channel and the second common channel to each other.

Description of the Related Art

Conventionally, there is a publicly known ink-jet head having a configuration wherein a common supply channel branch (first common channel) extending in a Y direction and a common discharge channel branch (second common channel) extending in the Y direction are connected to each other at one ends thereof, respectively, on one side in the Y direction. In this case, an ink flows along a route from the other end toward one end in the Y direction of the common supply channel branch, and further from the one end toward the other end in the Y direction of the common discharge channel branch.

SUMMARY

In the above-described ink-jet head, during a period of time in which the liquid flows along the above-described route, the temperature of the liquid might be changed. For example, in a case that a heated liquid is supplied to the common supply channel branch, the head is released in a process during which the liquid flows along the route, and the temperature of the liquid might be further lowered at a location farther on the downstream side of the route. Alternatively, the temperature of the liquid might be increased due to a heat of an actuator (piezoelectric body, heating element, etc.) which applies a discharge energy to the liquid inside an ejector (individual channel), which in turn might raise the temperature of the liquid to be higher at a location farther on the downstream side of the route.

In a case that such a change in the temperature is occurring, it is conceivable to detect the average temperature of the liquid in the entire channel by a temperature sensor and to appropriately select a discharge waveform for the liquid based on a result of the detection, for the purpose of maintaining the quality of recording. However, depending on the position of the temperature sensor, it might not be possible to accurately detect the average temperature of the liquid in the entire channel, and it might be difficult to maintain the quality of the recording.

An object of the present disclosure is to provide a liquid discharge head capable of accurately detecting the average temperature of the liquid in the entire channel.

According to an aspect of the present disclosure, there is provided a liquid discharge head including: a channel member including: a plurality of individual channels aligned in a first direction; a first common channel extending in the first direction and communicating with the plurality of individual channels; a second common channel extending in the first direction, communicating with the plurality of individual channels and arranged side by side to the first common channel in a second direction crossing the first direction; and a connecting channel extending in the second direction and connecting an end in the first direction of the first common channel and an end in the first direction of the second common channel; and a temperature sensor overlapping with the connecting channel in the second direction.

DESCRIPTION OF THE EMBODIMENTS

First Embodiment

Figure 1:
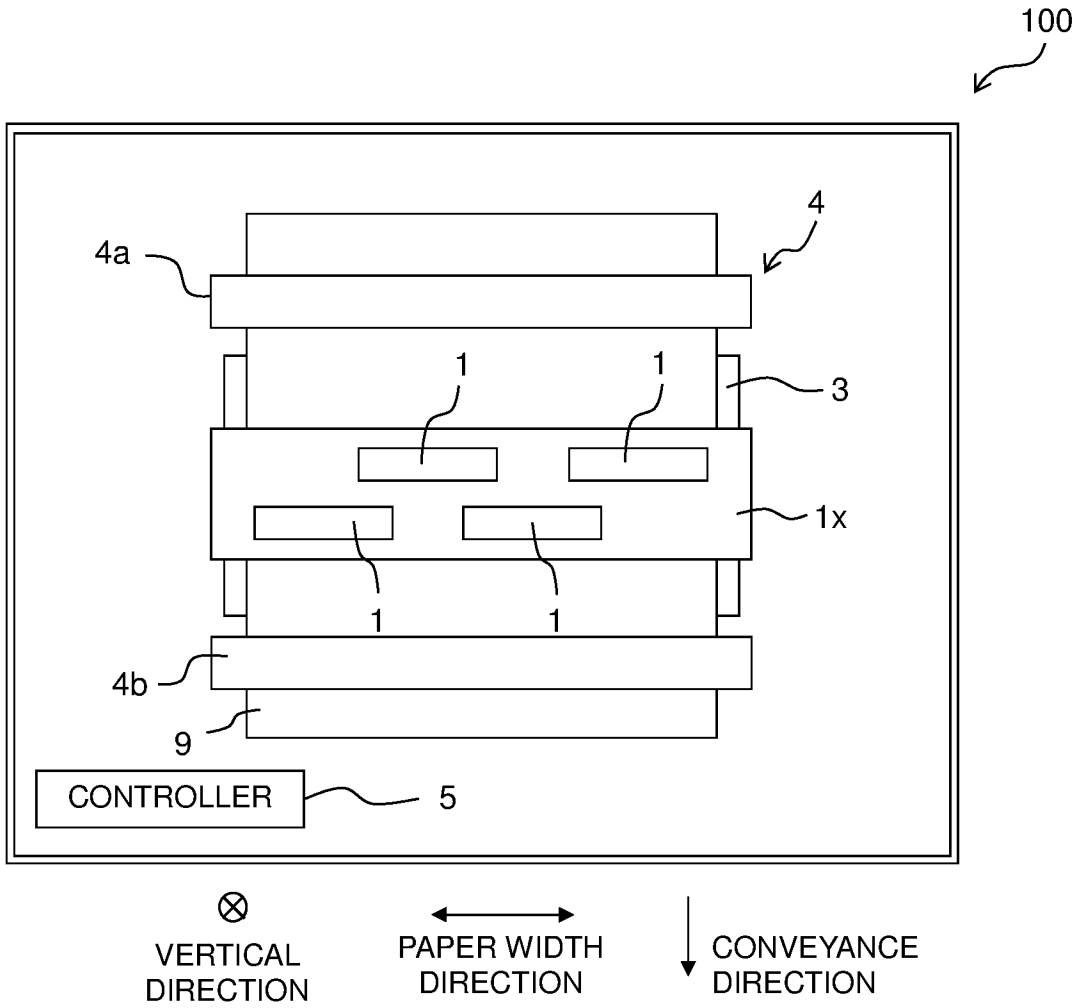
FIG. 1 is a plan view of a printer 100 provided with a head 1.

Firstly, the overall configuration of a printer 100 provided with a head 1 according to a first embodiment of the present disclosure will be explained, with reference to FIG. 1.

The printer 100 is provided with a head unit 1*x* including four heads 1, a platen 3, a conveyor 4 and a controller 5.

A paper sheet (sheet, paper) 9 is placed on the upper surface of the platen 3.

The conveyor 4 has two roller pairs 4*a* and 4*b* which are arranged with the platen 3 intervened therebetween in a conveyance direction. In a case that a conveying motor (of which illustration is omitted in the drawings) is driven by control of the controller 5, the roller pairs 4*a* and 4*b* rotate in a state that the paper sheet 9 is sandwiched or pinched therebetween, thereby conveying the paper sheet 9 in the conveyance direction.

The head unit 1*x* is elongated in a paper width direction (direction orthogonal to both of the conveyance direction and the vertical direction), and is of a line system wherein an ink is discharged with respect to the paper sheet 9 from nozzles 21 (see FIGS. 2 and 3) in a state that the position of the head unit 1*x* is fixed. The four heads 1 are each elongated in the paper width direction, and are arranged in a staggered manner in the paper width direction.

The controller 5 has a Read Only Memory (ROM), a Random Access Memory (RAM) and an Application Specific Integrated Circuit (ASIC). The ASIC executes a recording processing, etc., in accordance with a program stored in the ROM. In the recording processing, the controller 5 controls a driver IC and a conveyance motor (both of which are omitted in the illustration of the drawings) of each of the heads 1, based on a recording instruction or recording command (including image data) inputted from an external apparatus or external device such as a PC, and performs recording of an image, etc., on the paper sheet 9.

Next, the configuration of the head 1 will be explained with reference to FIGS. 2 to 4.

Figure 2:
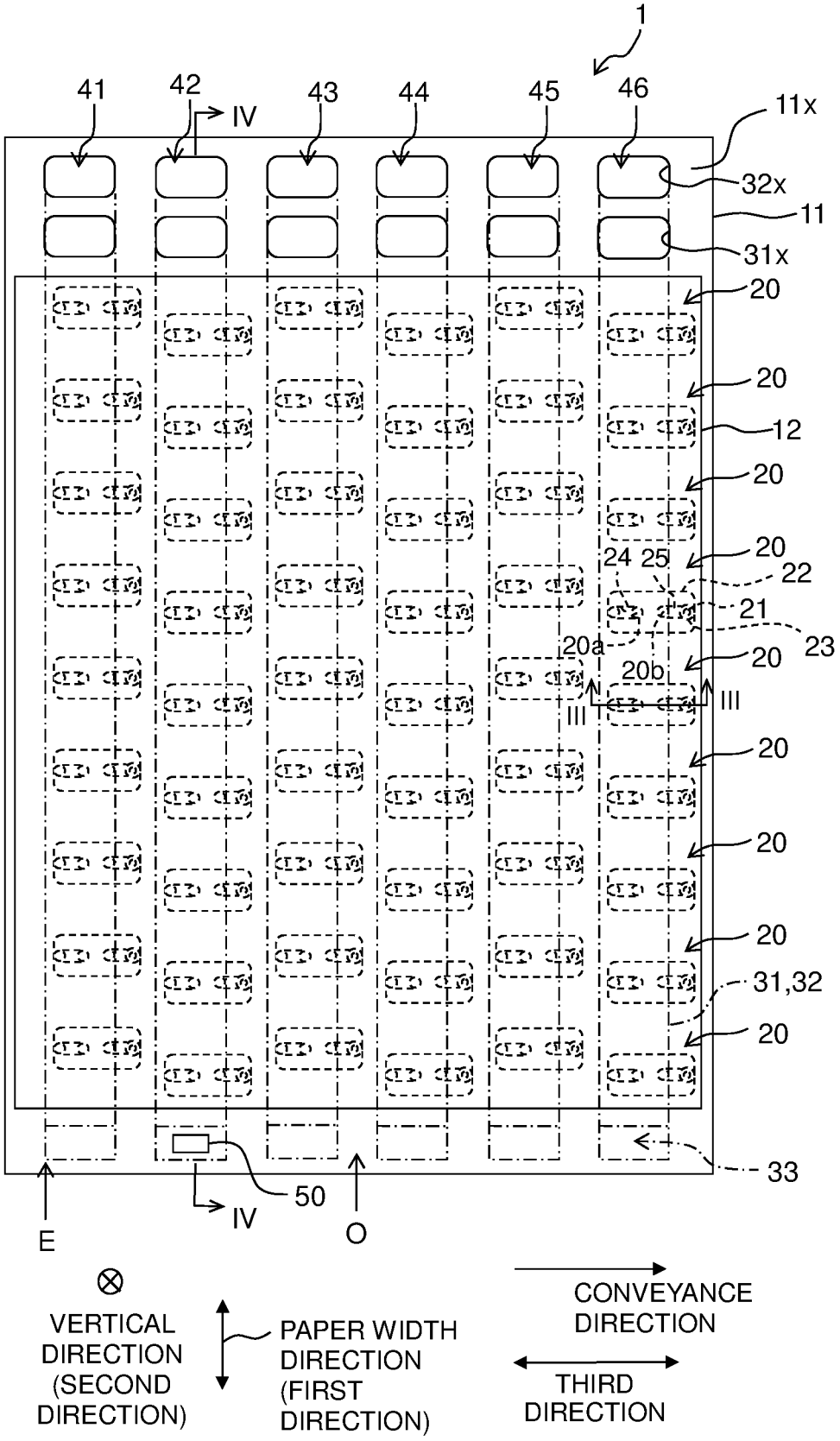
FIG. 2 is a plan view of the head 1.
Figure 4:
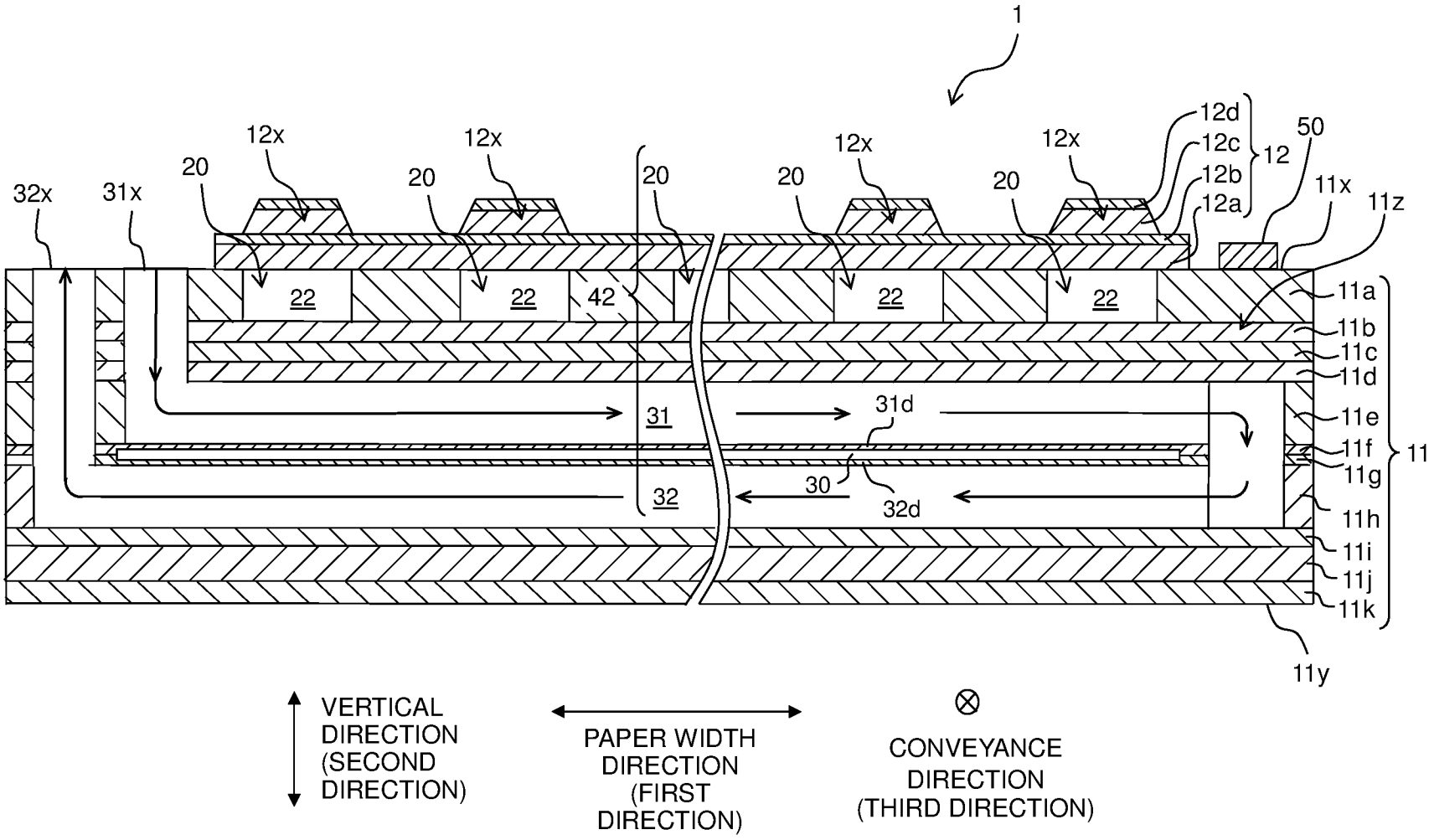
FIG. 4 is a cross-sectional view of the head 1, taken along a line IV-IV in FIG. 2.

As depicted in FIGS. 2 and 4, the head 1 has a channel substrate 11, an actuator substrate 12, and a temperature sensor 50.

Figure 3:
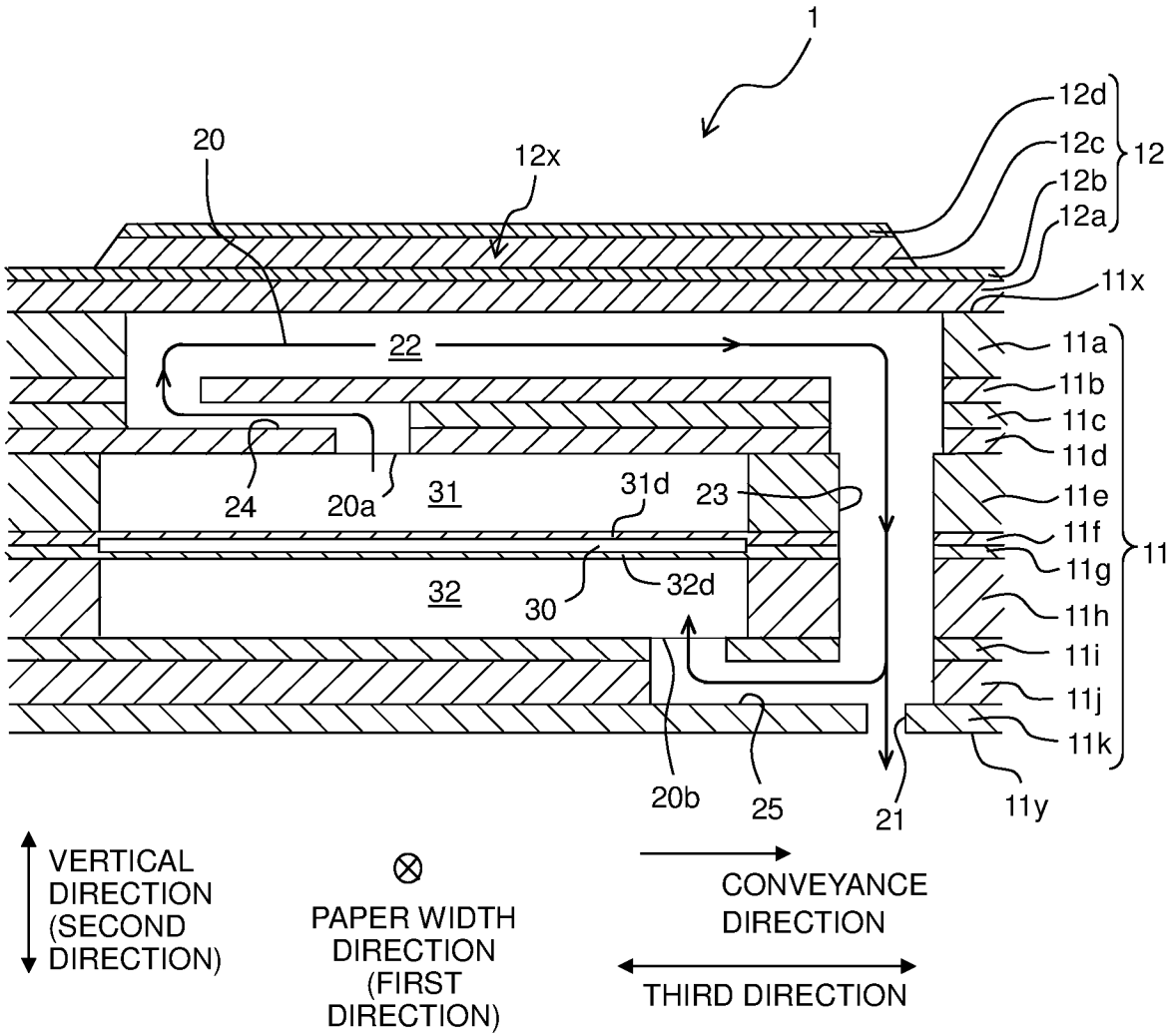
FIG. 3 is a cross-sectional view of the head 1, taken along a line III-III in FIG. 2.

As depicted in FIGS. 3 and 4, the channel substrate 11 is constructed of eleven plates 11*a* to 11*k* which are stacked in the vertical direction and adhered to one another. Each of the plates 11*a* to 11*k* has a through hole formed therein and constructing a channel. The channel includes a plurality of individual channels 20, a supply channel 31, a return channel 32, and a connecting channel 33.

As depicted in FIG. 2, the channel substrate 11 is provided with 6 (*six*) channel sets 41 to 46 each of which is constructed of the plurality of individual channels 20 arranged in a row (array) in the paper width direction (first direction), and the supply channel 31, the return channel 32 and the connecting channel 33 which are communicated with the plurality of individual channels 20.

In each of the six channel sets 41 to 46, the supply channel 31 and the return channel 32 are arranged side by side in the vertical direction (second direction: a height direction of each of the supply channel 31 and the return channel 32, and is a direction crossing the first direction), and overlap with each other in the vertical direction, as depicted in FIGS. 3 and 4. The supply channel 31 corresponds to a "first common channel" of the present disclosure. The return channel 32 corresponds to a "second common channel" of the present disclosure.

The six channel sets 41 to 46 are arranged side by side, at equal intervals, in a direction parallel to the conveyance direction (third direction: a width direction of each of the supply channel 31 and the return channel 32, and is a direction orthogonal to both of the first direction and the second direction).

Each of the supply channel 31 and the return channel 32 extends in the first direction. The supply channel 31 and the return channel 32 have lengths (lengths in the first direction), widths (lengths in the third direction) and heights (lengths in the second direction) which are substantially same, respectively, to each other.

In each of the channel sets 41 to 46, the connecting channel 33 extends in the second direction and links an end in the first direction of the supply channel 31 and an end in the first direction of the return channel 32 to each other, as depicted in FIG. 4.

The supply channel 31 and the return channel 32 communicate with a sub tank (omitted in the drawings) via a supply port 31*x* and a return port 32*x* provided on the other ends thereof, respectively, in the first direction (upper ends thereof in FIG. 2). The supply port 31*x* and the return port 32*x* are open in an upper surface 11*x* of the channel substrate 11.

In each of the channel sets 41 to 46, the supply port 31*x* and the return port 32*x* are on a same side in the first direction with respect to the plurality of individual channels 20, and are arranged side by side in the first direction. In the first direction, the supply port 31*x* is located between the plurality of individual channels 20 and the return port 32*x*. Namely, the spacing distance in the first direction between the return port 32*x* and the plurality of individual channels 20 is greater than the spacing distance in the first direction between the supply port 31*x* and the plurality of individual channels 20.

The sub tank communicates with a main tank storing the ink, and stores the ink supplied from the main tank thereto. In a case that a pump (omitted in the drawings) is driven by control performed by the controller 5, the ink inside the sub tank is thereby caused to flow into the supply channel 31 from the supply port 31*x*. The ink inflowed into the supply channel 31 is supplied to each of the plurality of individual channels 20 while moving inside the supply channel 31 from the other end in the first direction (upper end in FIG. 2; left end in FIG. 4) toward one end in the first direction (lower end in FIG. 2; right end in FIG. 4) (see FIG. 3). The ink outflowed from each of the plurality of individual channels 20 inflows into the return channel 32. Further, the ink reaching the one end in the first direction (lower end in FIG. 2; right end in FIG. 4) of the supply channel 31 flows through the connecting channel 33 and flows into the return channel 32. The ink inflowed into the return channel 32 moves inside the return channel 32 from the one end in the first direction (lower end in FIG. 2; right end in FIG. 4) toward the other end in the first direction (upper end in FIG. 2; left end in FIG. 4), and is returned to the sub tank via the return port 32*x*.

As depicted in FIGS. 3 and 4, the supply channel 31 is formed of a through hole formed in the plate 11*e*. The return channel 32 is formed of a through hole formed in the plates 11*h*. A damper chamber 30 is provided at a location between the supply channel 31 and the return channel 32 in the second direction. The damper chamber 30 is formed of a recessed part formed in the plate 11*f* and a recessed part formed in the plate 11*g*. The bottom part of the recessed part in the plate 11*f* functions as a damper film 31*d* of the supply channel 31. The bottom part of the recessed part in the plate 11*g* functions as a damper film 32*d* of the return channel 32.

As depicted in FIG. 3, each of the plurality of individual channels 20 includes a nozzle 21, a pressure chamber 22, a connecting channel 23, an inflow channel 24 and an outflow channel 25.

The nozzle 21 is formed of a through hole formed in the plate 11*k*, and is open in a lower surface 11*y* of the channel substrate 11.

The pressure chamber 22 is formed of a through hole formed in the plate 11*a*, and is open in the upper surface 11*x* of the channel substrate 11. The pressure chamber 22 has a substantially rectangular shape which is elongated in the third direction in a plane parallel to the first and third directions (a plane orthogonal to the second direction). With respect to the pressure chamber 22, the inflow channel 24*a* is connected to one end in the third direction of the pressure chamber 22, and the connecting channel 23 is connected to the other end in the third direction of the pressure chamber 22.

Here, the channel substrate 11 corresponds to a "channel member" of the present disclosure, and the lower surface 11*x* corresponds to a "nozzle surface" of the present disclosure, and the upper surface 11*x* corresponds to an "opposite surface" of the present disclosure. Each of the lower surface 11*y* and the upper surface 11*x* crosses the second direction.

The connecting channel 23 is formed of through holes formed in the plates 11*b* to 11*j*, respectively, and extends in the second direction. The connecting channel 23 is arranged between the nozzle 21 and the pressure chamber 22 in the second direction, and connects the nozzle 21 and the pressure chamber 22 to each other.

The inflow channel 24 is formed of through holes formed in the plates 11*b* to 11*d*, respectively. The inflow channel 24 has an upper end connected to the pressure chamber 22 and a lower end (an inlet port 20*a* of the individual channel 20) connected to the supply channel 31.

The outflow channel 25 is formed of through holes formed in the plates 11*i* to 11*j*, respectively. The outflow channel 25 has an end connected to a lower end of the connecting channel 23 and the other end (an outlet port 20*b* of the individual channel 20) connected to the return channel 32.

Each of the inflow channel 24 and the outflow channel 25 has a width (length in the first direction) which is smaller than a width (length in the first direction) of the pressure chamber 22, and functions as a throttle.

The ink supplied from the supply channel 31 to each of the plurality of individual channels 20 passes through the inflow channel 24*a* and inflows into the pressure chamber 22, moves substantially horizontally in the inside of the pressure chamber 22, and then inflows into the connecting channel 23. The ink inflowed into the connecting channel 23 moves downward; a part or portion of the ink is discharged from the nozzle 21, and a remaining part of the ink passes through the outflow channel 25 and inflows into the return channel 32.

In such a manner, the ink is circulated between the sub tank and the channel substrate 11, thereby realizing discharge of air and/or prevention of increase in the viscosity of the ink in the supply channel 31 and the return channel 32, and further in each of the individual channels 20, which are formed in the channel substrate 11. Further, in such a case that the ink contains a sedimentary component (a component which might sediment or settle; a pigment, etc.), such a sedimentary component is agitated, which in turn prevents any sedimentation thereof from occurring.

As depicted in FIG. 3, the actuator substrate 12 includes, in an order from the lower side thereof, a vibration plate 12*a*, a common electrode 12*b*, a plurality of piezoelectric bodies 12*c* and a plurality of individual electrodes 12*d*.

The vibration plate 12*a* and the common electrode 12*b* are arranged on the upper surface 11*x* of the channel substrate 11, and covers all the pressure chambers 22 formed in the plate 11*a*. On the other hand, each of the plurality of piezoelectric bodies 12*c* and each of the plurality of individual electrodes 12*d* are provided with respect to one of the pressure chambers 22, and overlap with one of the pressure chambers 22 in the second direction.

The common electrode 12*b* and the plurality of individual electrodes 12*d* are electrically connected to a driver IC (omitted in the drawings). The driver IC maintains the potential of the common electrode 12*b* at the ground potential, whereas changes the potential of each of the plurality of individual electrodes 12*d*. Specifically, the driver IC generates a driving signal based on a control signal from the controller 5, and applies the driving signal to each of the plurality of individual electrodes 12*d*. With this, the potential of each of the plurality of individual electrodes 12*d* is changed between a predetermined driving potential and the ground potential. In this situation, parts or portions in the vibration plate 12*a* and one of the plurality of piezoelectric bodies 12*c*, respectively, which are sandwiched between each of the plurality of individual electrodes 12*d* and one of the pressure chambers 22 corresponding thereto (actuator 12*x*) are deformed so as to project toward one of the pressure chambers 22. In this situation, the volume of one of the pressure chambers 22 is changed to thereby apply the pressure to the ink inside the one of the pressure chambers 22, causing the ink to be discharged from one of the nozzles 21 corresponding thereto. The actuator substrate 12 has a plurality of pieces of the actuator 12*x* corresponding to the pressure chambers 22, respectively.

In the present embodiment, among the six channel sets 41 to 46, the temperature sensor 50 is provided on the channel set 42 which is second from the left in FIG. 2. Among the six channel sets 41 to 46, the channel set 42 is positioned most closely to a middle point, in the third direction, between a center O in the third direction of an arrangement area of the six channel sets 41 to 46 and an end E in the third direction of the arrangement area.

As depicted in FIG. 4, the temperature sensor 50 is arranged on the upper surface 11*x* of the channel substrate 11, and overlaps, in the second direction, with the connecting channel 33 of the channel set 42. For example, the width (length in the third direction) of the temperature sensor 50 is in a range of 2 mm to 3 mm, and the width (length in the third direction) of the connecting channel 33 is approximately in a range of 0.5 mm to 3.0 mm. Further, the temperature sensor 50 is located at one end in the first direction of the channel substrate 11, and is separated away from the plurality of actuators 12*x*.

An interposed part 11*z* which is constructed of the plates 11*a* to 11*d* is interposed between the temperature sensor 50 and the connecting channel 33 in the second direction. The plates 11*a* to 11*d* are each formed of a material with a high thermal conductivity (a metal, silicon, carbon, etc.).

The temperature sensor 50 may be, for example, an NTC thermistor (Negative Temperature Coefficient thermistor) formed of a material of which electric resistance is changed depending on the temperature (a composite metal oxide of Mn, Ni, Co, etc.). The temperature detected by the temperature sensor 50 is used to perform discharge control (determination of the driving voltage, the driving pulse width, the pulse number which are to be applied to the actuator 12*x*, etc.).

As described above, according to the present embodiment, the temperature sensor 50 overlaps, in the second direction, with the connecting channel 33 connecting the supply channel 31 and the return channel 32 (see FIG. 4). The connecting channel 33 is located between the supply channel 31 and the return channel 32 in the path or route of the ink flowing through the supply channel 31 and the return channel 32. Accordingly, in the present embodiment (in the case that the temperature sensor 50 overlaps, in the second direction, with the connecting channel 33), it is possible to detect the average temperature of the ink in the entire channel in the head 1 with a high precision or accuracy, as compared with another case that the temperature sensor 50 overlaps, in the second direction, with the supply channel 31 or the return channel 32.

Further, the connecting channel 33 extends in the second direction, and the direction of the flow of the ink in the connecting channel 33 is the second direction; thus, in the inside of the connecting channel 33, any change in the temperature of the ink easily occur in the second direction. Provided that the temperature sensor 50 overlaps, in the first direction, with the connecting channel 33 (for example, in such a case that the temperature sensor 50 is provided on a side surface of the channel substrate 11), there is such a fear that any positional deviation in the second direction might occur during the arrangement of the temperature sensor 50. In such a case, any change in the detected temperature might be large, depending on the position in the second direction of the temperature sensor 50, which in turn makes it hard to detect the average temperature accurately. In contrast, in the present embodiment, the temperature sensor 50 overlaps, in the second direction, with the liking channel 33; thus, any positional deviation in the second direction does not occur in a case of arranging the temperature sensor 50, and the above-described problem of deterioration in the detection accuracy is less likely to occur. Note that in the present embodiment, since the temperature sensor 50 overlaps, in the second direction, with the connecting channel 33, any positional deviation in the first direction or in the third direction might occur during the arrangement of the temperature sensor 50. However, any change in the detected temperature depending on the position in the first direction and/or the third direction of the temperature sensor 50 is small as compared with any change in the detected temperature depending on the position in the second direction of the temperature sensor 50. In particular, the third direction is not the flow direction of the ink, and the temperatures of the ink in the one end, the other end and the center in the third direction in the connecting channel 33 are same to one another. Accordingly, even in a case that any positional deviation in the third direction of the temperature sensor 50 occurs, it is possible to maintain the accuracy of the detection.

The temperature sensor 50 is arranged on the upper surface 11*x* of the channel substrate 11 (see FIG. 4). In a case that the temperature sensor 50 is arranged on the lower surface 11*y* of the channel substrate 11, there might be such a case that a wiper which wipes the lower surface 11*y* makes contact with the temperature sensor 50, and that the wiping cannot be performed appropriately. In the present embodiment, since the temperature sensor 50 is arranged on the upper surface 11*x* of the channel substrate 11, there is no such a fear that the wiper wiping the lower surface 11*y* might make contact with the temperature sensor 50.

The temperature sensor 50 is separated away from the plurality of actuators 12*x* (see FIG. 4). In this case, it is possible to suppress the conduction of heat from the plurality of actuators 12*x* to the temperature sensor 50, and thus to maintain the accuracy of the detection.

The interposed part 11*z* which is constructed at least one of the metal, the silicon and the carbon is interposed between the temperature sensor 50 and the connecting channel 33 (see FIG. 4). In this case, the temperature can be detected accurately via the interposed part 11*z* having the high thermal conductivity.

Each of the individual channels 20 has the inlet port 20*a* communicating with the supply channel 31 and the outlet port 20*b* communicating with the return channel 32 (see FIGS. 2 and 3). In this case, during the recording, there are generated: a flow of the ink starting from the other end in the first direction (the upper end in FIG. 2, the left end in FIG. 4) to one end (the lower end in FIG. 2, the right end in FIG. 4) of the supply channel 31, then passing through the connecting channel 33, and then heading, from the one end in the first direction (the lower end in FIG. 2, the right end in FIG. 4), toward the other end (the upper end in FIG. 2, the left end in FIG. 4) of the return channel 32; and a flow of the ink starting from the supply channel 31, then passing through each of the individual channels 20, and then heading toward the return channel 32. By the above-described flows of the ink which are generated during the recording, it is possible to discharge the air inside the individual channels 20, to agitate any sedimentary component in the ink, and to realize an uniformized average temperature of the ink in the entire channel. Further, in the configuration wherein the above-described flows of the inks are generated during the recording, the temperature is detected by the temperature sensor 50 to thereby make it possible to detect the average temperature of the entire channel accurately, and to maintain the quality of the recording to be satisfactory.

The six channel sets 41 to 46 are arranged side by side in the third direction (see FIG. 2). In this case, the miniaturization in the second direction can be realized, as compared with another case wherein the six channel sets 41 to 46 are arranged side by side in the second direction.

Among the six channel sets 41 to 46, the temperature in a certain channel set which is closer to the one end E (see FIG. 2) or the other end in the third direction of the arrangement area of the six channel sets 41 to 46 might be low, and the temperature in another channel set which is closer to the center O in the third direction of the arrangement area might be high, due to the relationship with the ambient temperature of the head 1 and/or the temperature from yet another or other channel sets different from the certain or another channel set. In the present embodiment, among the six channel sets 41 to 46, the temperature sensor 50 is provided on the channel set 42 (the channel set which is positioned most closely to the middle point, in the third direction, between the center O in the third direction of the arrangement area of the six channel sets 41 to 46 and the end E in the third direction of the arrangement area). With this, it is possible to accurately detect the average temperature of the six channel sets 41 to 46 as a whole.

Second Embodiment

Figure 5:
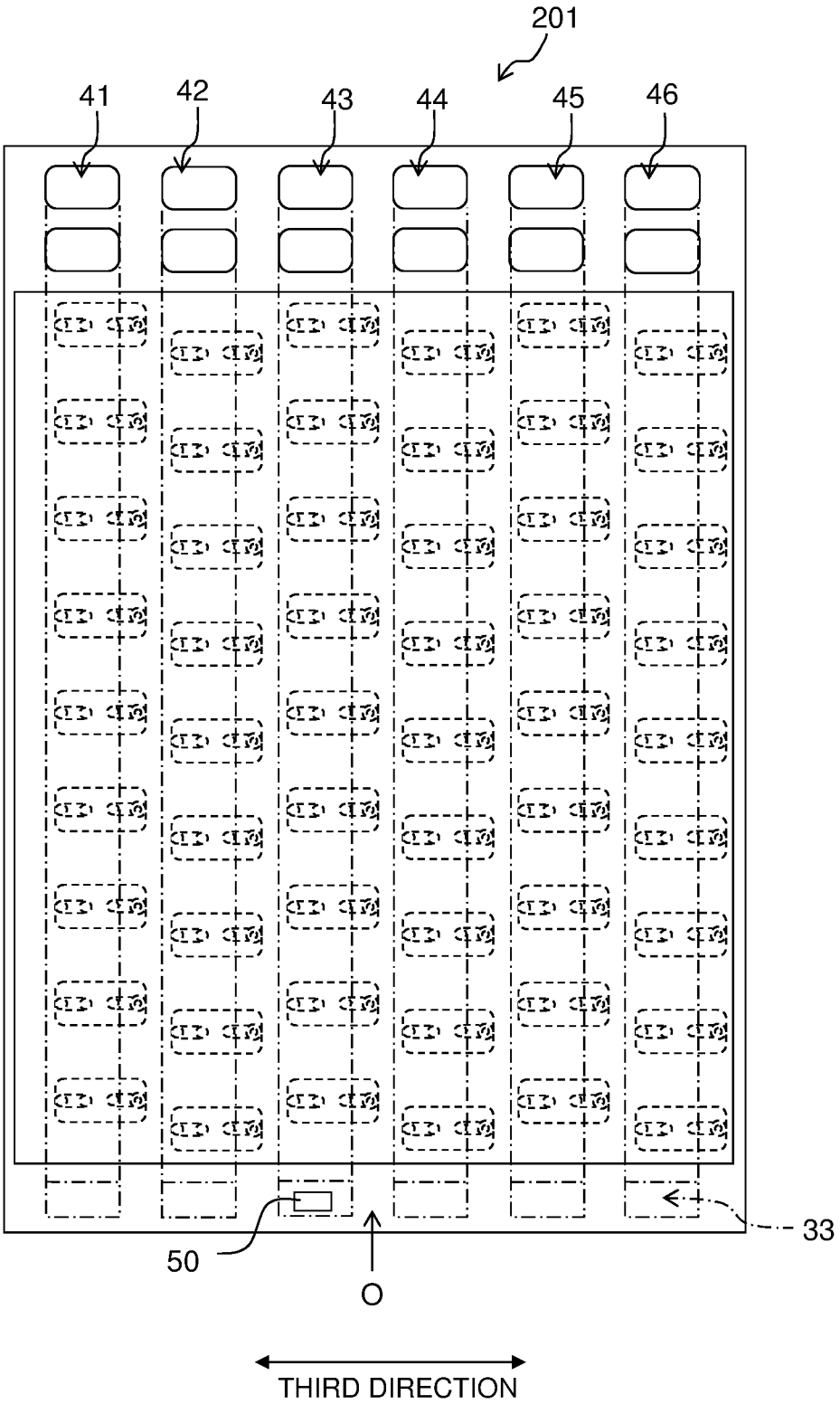
FIG. 5 is a plan view of a head 201.

Next, a head 201 according to a second embodiment of the present disclosure will be explained, with reference to FIG. 5.

In the first embodiment (FIG. 2), the temperature sensor 50 is provided on the channel set 42 (the channel set which is positioned most closely to the middle point, in the third direction, between the center O in the third direction of the arrangement area of the six channel sets 41 to 46 and the end E in the third direction of the arrangement area). In the second embodiment (FIG. 5), however, a temperature sensor 50 is provided on the channel set 43 (the channel set which is positioned most closely, in the third direction, to the center O in the third direction of the arrangement area of the six channel sets 41 to 46).

According to the second embodiment wherein although the position of the temperature sensor 50 is different from that in the first embodiment, the second embodiment satisfies the requirement similar to that in the first embodiment, thereby achieving the effects similar to those in the first embodiment.

Further, in the second embodiment, since the temperature sensor 50 is provided on the channel set 43 which is positioned most closely to the center O in the arrangement area of the six channel sets 41 to 46, it is possible to detect the maximum temperature in the six channel sets 41 to 46 as a whole, and to calculate the average temperature of the six channel sets 41 to 46 based on the maximum temperature. Furthermore, it is possible to perform control based on the maximum temperature (a processing of stopping or pausing the recording in a case that the maximum temperature exceeds a threshold value, etc.).

Third Embodiment

Figure 6:
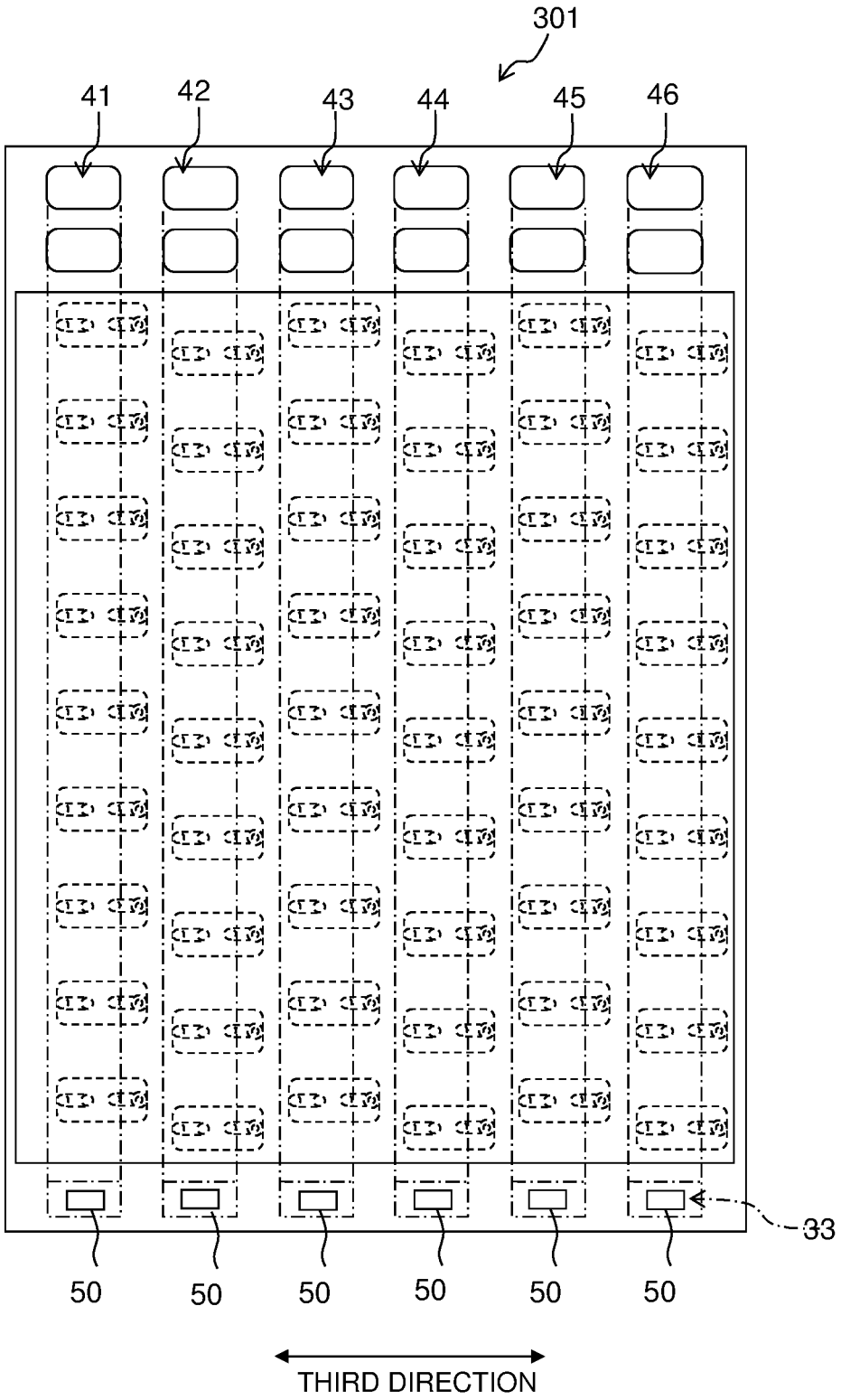
FIG. 6 is a plan view of a head 301.

Next, a head 301 according to a third embodiment of the present disclosure will be explained, with reference to FIG. 6.

In the first embodiment (FIG. 2), the temperature sensor 50 is provided on the channel set 42 (the channel set which is positioned most closely to the middle point, in the third direction, between the center O in the third direction of the arrangement area of the six channel sets 41 to 46 and the end E in the third direction of the arrangement area). In the third embodiment (FIG. 6), however, temperature sensors 50 are provided on the six channel sets 41 to 46, respectively.

According to the third embodiment wherein although the position of the temperature sensor 50 is different from that in the first embodiment, the third embodiment satisfies the requirement similar to that in the first embodiment, thereby achieving the effects similar to those in the first embodiment.

Further, in the third embodiment, since the temperature sensors 50 are provided on the six channel sets 41 to 46, respectively, it is possible to detect the temperatures in the respective six channel sets 41 to 46, and to calculate the average of the temperatures of the six channel sets 41 to 46, and thus it is possible to calculate the average temperature of the six channel sets 41 to 46 as a whole with a higher accuracy.

Fourth Embodiment

Next, a head 401 according to a fourth embodiment of the present disclosure will be explained, with reference to FIGS. 7 and 8.

In the first embodiment (FIG. 2), the six channel sets 41 to 46 are provided. In the fourth embodiment (FIG. 7), however, two channel sets 441 and 442 (first and second channel sets 441 and 442) are provided.

Further, in the first embodiment (FIGS. 2 and 4), the supply channel 31 and the return channel 32 are linked to each other by the connecting channel 33 in each of the six channel sets 41 to 46. In the fourth embodiment (FIGS. 7 and 8), however, a supply channel 31 of the first channel set 441 and a return channel 32 of the second channel set 442 are linked to each other by a first connecting channel 433*a*, and a return channel 32 of the first channel set 441 and a supply channel 31 of the second channel set 442 are linked to each other by a second connecting channel 433*b*.

Each of the first and second channel sets 441 and 442 is constructed of a plurality of individual channels 20 arranged in a row in the first direction, and a supply channel 31 and a return channel 32 which communicate with the plurality of individual channels 20. The two channel sets 441 and 442 are arranged side by side in the third direction, and are linked to each other by the first and second connecting channels 433*a* and 433*b*.

The configurations of the plurality of individual channels 20, the supply channel 31 and the return channel 32 in each of the first and second channel sets 441 and 442 are similar to those in the first embodiment. Note, however, that in the six channel sets 41 to 46 of the first embodiment (FIG. 2), the connecting channels 23 and the nozzles 21 in the respective individual channels 20 are located on a same side (right side in FIG. 2) relative to the supply channel 31 and the return channel 32, whereas in the two (first and second) channel sets 441 and 442 of the fourth embodiment (FIGS. 7 and 8), the connecting channels 23 and the nozzles 21 in the respective individual channels 20 are located, relative to the supply channel 31 and the return channel 32, on the opposite side to each other in the two (first and second) channel sets 441 and 442. Specifically, in the first channel set 441, the connecting channels 23 and the nozzles 21 in the respective individual channels 20 are located on one side in the third direction (left side in FIGS. 7 and 8) relative to the supply channel 31 and the return channel 32. In the second channel set 442, the connecting channels 23 and the nozzles 21 in the respective individual channels 20 are located on the other side in the third direction (right side in FIGS. 7 and 8) relative to the supply channel 31 and the return channel 32.

Figure 8:
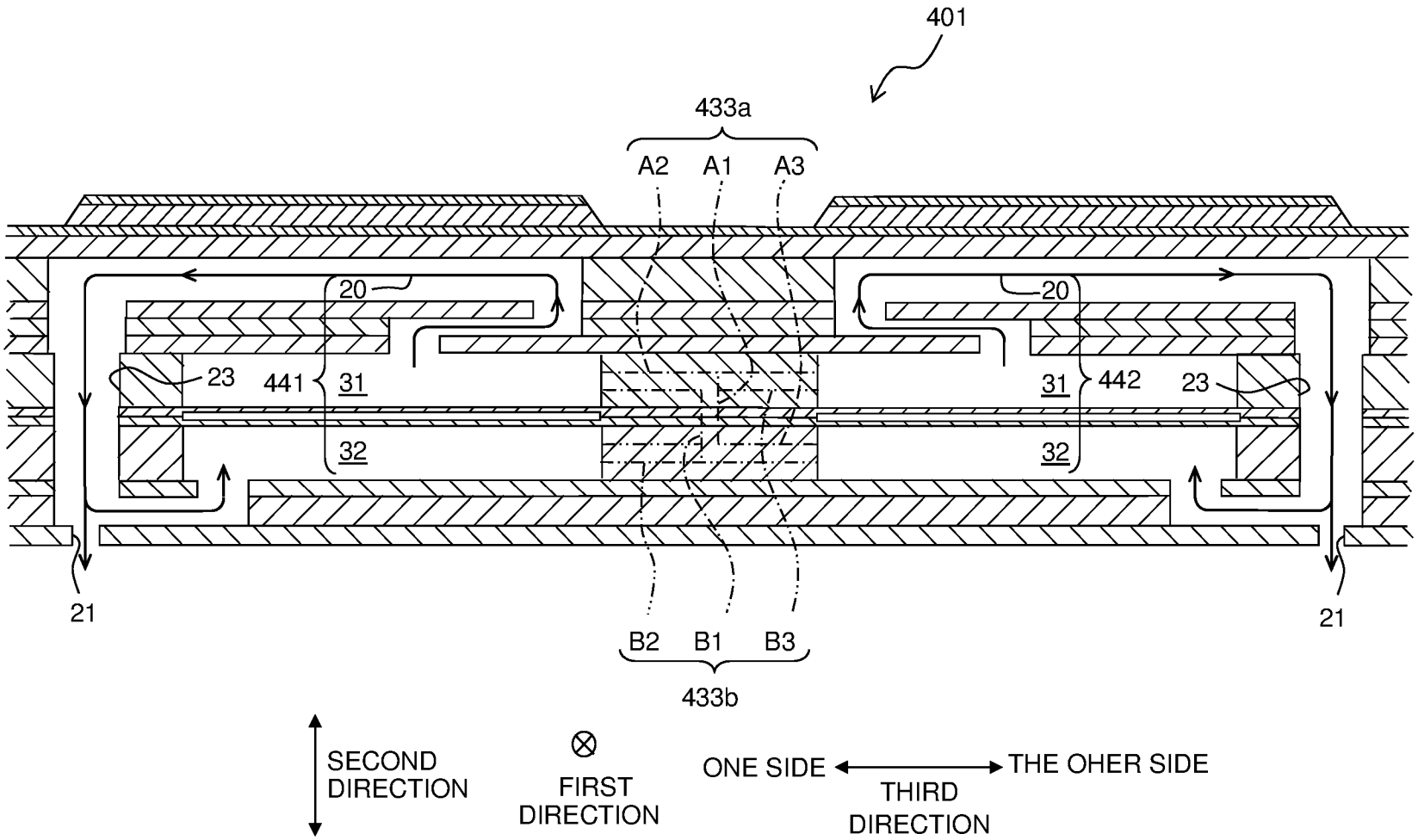
FIG. 8 is a cross-sectional view of the head 401, taken along a line VIII-VIII in FIG. 7.

As depicted in FIG. 8, in each of the first and second channel sets 441 and 442, the supply channel 31 and the return channel 32 are arranged side by side in the second direction, and overlap with each other in the second direction. The supply channel 31 of the first channel set 441 and the supply channel 31 of the second channel set 442 are arranged side by side in the third direction. The return channel 32 of the first channel set 441 and the return channel 32 of the second channel set 442 are arranged side by side in the third direction.

The supply channel 31 of the first channel set 441 and the return channel 32 of the second channel set 442 are arranged side by side in the second direction, and are arranged side by side in the third direction (namely, the position in the second direction of the supply channel 31 of the first channel set 441 and the position in the second direction of the return channel 32 of the second channel set 442 are different from each other; and the position in the third direction of the supply channel 31 of the first channel set 441 and the position in the third direction of the return channel 32 of the second channel set 442 are different from each other). In other words, the supply channel 31 of the first channel set 441 and the return channel 32 of the second channel set 442 face each other in an oblique direction which is orthogonal to the first direction and which crosses both of the second and third directions.

The return channel 32 of the first channel set 441 and the supply channel 31 of the second channel set 442 are arranged side by side in the second direction, and are arranged side by side in the third direction (namely, the position in the second direction of the return channel 32 of the first channel set 441 and the position in the second direction of the supply channel 31 of the second channel set 442 are different from each other; and the position in the third direction of the return channel 32 of the first channel set 441 and the position in the third direction of the supply channel 31 of the second channel set 442 are different from each other). In other words, the return channel 32 of the first channel set 441 and the supply channel 31 of the second channel set 442 face each other in the above-described oblique direction.

The first connecting channel 433*a* has a first part A1 extending in the second direction, a second part A2 extending toward one side in the third direction from an upper end portion of the first part A1, and a third part A3 extending toward the other side in the third direction from a lower end portion of the first part A1. The second connecting channel 433*b* has a first part B1 extending in the second direction, a second part B2 extending toward one side in the third direction from a lower end portion of the first part B1, and a third part B3 extending toward the other side in the third direction from an upper end portion of the first part B1.

Figure 7:
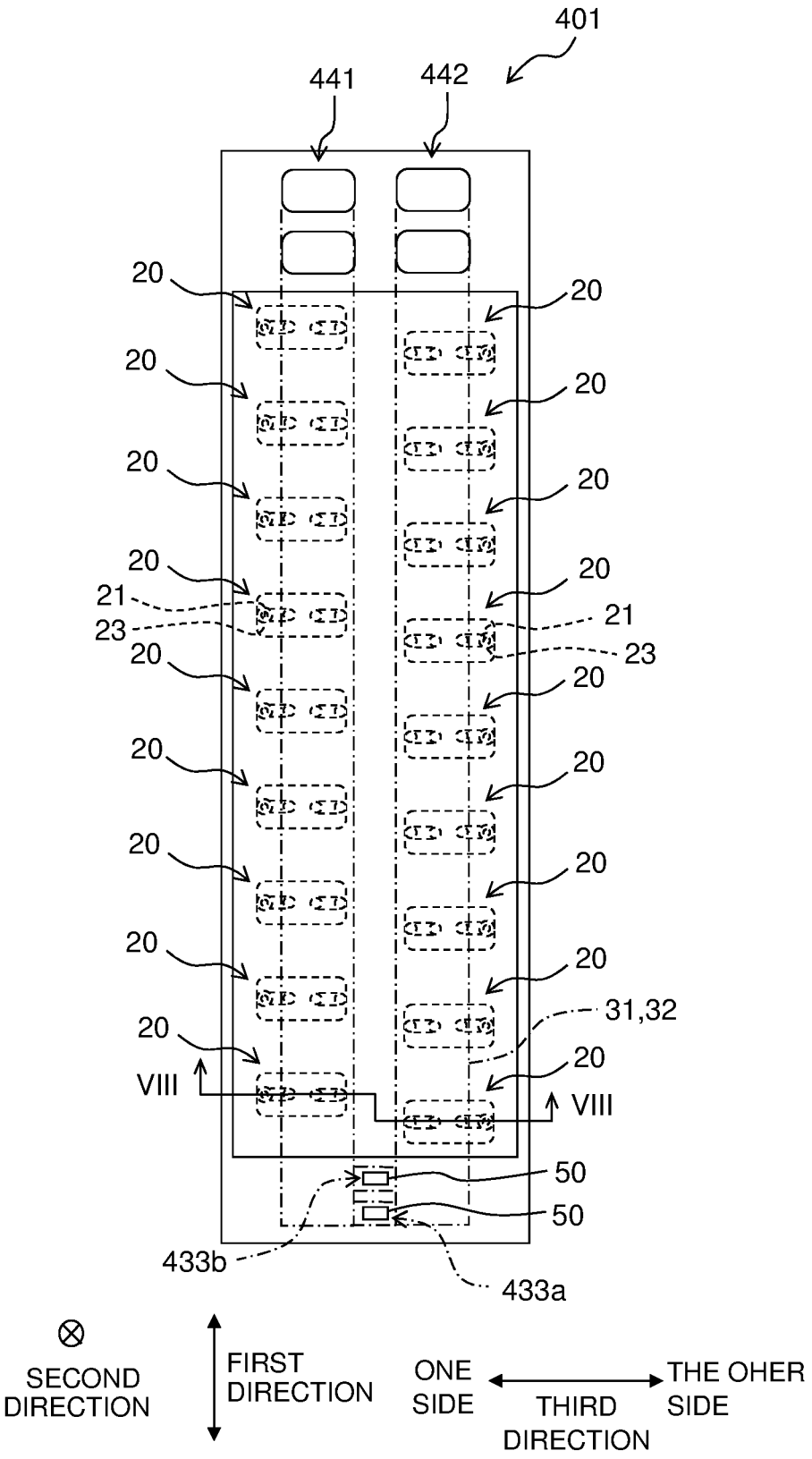
FIG. 7 is a plan view of a head 401.

As depicted in FIG. 7, the first connecting channel 433*a* and the second connecting channel 433*b* are arranged side by side in the first direction, and do not overlap with each other in the second direction.

Temperature sensors 50 are provided on the first connecting channel 433*a* and the second connecting channel 433*b*, respectively. Specifically, the temperature sensors 50 are provided at positions at which the temperature sensors 50 overlap, respectively, with the first part A1 of the first connecting channel 433*a* and the first part B1 of the second connecting channel 433*b* in the second direction.

As described above, according to the fourth embodiment wherein although the construction of the channel is different from that in the first embodiment, the fourth embodiment satisfies the requirement similar to that in the first embodiment, thereby achieving the effects similar to those in the first embodiment.

Further, in the fourth embodiment, the temperature sensors 50 are provided on the first and second connecting channels 433*a* and 433*b*, respectively (see FIG. 7). With this, it is possible to detect the temperatures in the two (first and second) connecting channels 433*a* and 433*b*, respectively, and to calculate the average of the temperatures of the two (first and second) connecting channels 433*a* and 433*b*, thereby making it possible to detect the average temperature of the two (first and second) channel sets 441 and 442 as a whole with a higher accuracy.

Furthermore, the supply channel 31 of the first channel set 441 and the return channel 32 of the second channel set 442 which face each other in the oblique direction are linked to each other by the first connecting channel 433*a*, and the return channel 32 of the first channel set 441 and the supply channel 31 of the second channel set 442 which face each other in the oblique direction are linked to each other by the second connecting channel 433*b* (see FIG. 8). By arranging the supply channels 31 and the return channels 32, which are linked to one another by the first and second connecting channels 433*a* and 433*b*, respectively, in the oblique direction, it is possible to suppress any crosstalk of a discharge pressure generated via the first and second connecting channels 433*a* and 433*b*.

<Modifications>

In the foregoing, the embodiments of the present disclosure have been explained. The present disclosure, however, is not limited to or restricted by the above-described embodiments; it is allowable to make a various kind of design changes to the present disclosure, within the scope described in the claims.

In the above-described embodiments, the first common channel is the supply channel, and the second common channel is the return channel. The present disclosure, however, is not limited to or restricted by this configuration. For example, it is allowable that the first common channel is the return channel, and the second common channel is the supply channel. Alternatively, it is allowable that both the first common channel and the second common channel are supply channels. Namely, in the present disclosure, the direction of flow of the liquid in the first and second common channels is not particularly limited.

It is allowable that the first common channel and the second common channel are arranged side by side in the width direction of each of the common channels. Namely, the second direction is not limited to the vertical direction.

It is allowable that the temperature sensor includes a part which overlaps with the connecting channel in the second direction and that the temperature sensor includes a part which does not overlap with the connecting channel in the second direction.

It is allowable that the temperature sensor is provided on the upper surface of the common electrode 12*b* (for example, a part, in the upper surface of the common electrode 12, at which the piezoelectric body 12*c* is not arranged). Alternatively, it is allowable that the temperature sensor is provided on the upper surface of the vibration plate 12*a* (for example, a part, in the upper surface of the common electrode 12, at which the common electrode 12*b* is not arranged).

In the first embodiment, it is allowable that the temperature sensor 50 is provided on the channel set 45. In the second embodiment, it is allowable that the temperature sensor 50 is provided on the channel set 44.

In each of the embodiments described above, the plurality of channel sets are provided. It is allowable, however, that one channel set (a plurality of individual channels and a first common channel, a second common channel and a connecting channel communicating with the plurality of individual channels) is provided.

It is allowable that each of the plurality of individual channels does not have any outlet port communicating with the second common channel Namely, it is allowable that the liquid does not circulate via the plurality of individual channels. For example, it is allowable to provide such a configuration that the liquid does not circulate via the plurality of individual channels, and that the liquid circulates between the first common channel and the second common channel. In such a case, it is possible to obtain the effects of the exhaust of air and/or the prevention of any increase in the viscosity in the liquid, in each of the common channels, etc.

Note that in the case of the configuration wherein the liquid circulates via the plurality of individual channels, the circulation is generally performed during the recording. However, in such a configuration that the liquid does not circulate via the plurality of individual channel, but the liquid circulates between the first common channel and the second common channel, the circulation is not performed generally during the recording, and the circulation is generally performed during maintenance of the head. In the case of the former configuration, it is possible that any variation in the temperature might be great depending on the recording duty; thus, the application of the present disclosure is further effective in enhancing the accuracy of the temperature detection.

Further, for example, it is allowable to provide such a configuration that the first common channel and the second common channel are both the supply channels, and that the liquid does not circulate. In such a case, the liquid flowing through the first common channel and the liquid flowing through the second common channel are allowed to merge or flow together at the connecting channel.

The interposed part which is interposed between the temperature sensor and the connecting channel may be constructed of a material different from the metal, silicon and carbon. Note that, however, it is preferred that the interposed part is constructed of a material with a high thermal conductivity so as to enhance the accuracy of the temperature detection by the temperature sensor.

The temperature sensor may be arranged on the nozzle surface. For example, the temperature sensor may be arranged, in the nozzle surface, at the outside of a nozzle formation area (an area in which the plurality of nozzles are formed).

Although the number of the nozzle belonging to each of the individual channels is 1 (one) in the above-described embodiments, it is allowable that the number of nozzle belonging to each of the individual channels may be not less than 2 (two).

The liquid discharge head is not limited to being the head of the line system; it is allowable that the liquid discharge head is a head of a serial system (a system in which the head discharges a liquid from a nozzle toward an object or target of discharge, while the head moves in a scanning direction parallel to the paper width direction).

The object of discharge is not limited to being a paper sheet (sheet, paper); the object of discharge may be, for example, cloth (fabric), substrate, etc.

The liquid discharged (dischargeable) from the nozzle is not limited to being the ink; it is allowable that the liquid is any liquid (for example, a treating liquid causing a component in the ink to aggregate or deposit; etc.).

The present disclosure is not limited to being applicable to the printer; the present disclosure is applicable also to a facsimile machine, copying machine, a multifunction peripheral, etc. Further, the present disclosure is also applicable to a liquid discharge apparatus usable for a usage different from recording of an image (for example, a liquid discharge apparatus configured to discharge a conductive liquid onto a substrate so as to form a conductive pattern), etc.

What is claimed is:

1. A liquid discharge head comprising:

a channel member including:

a plurality of individual channels aligned in a first direction, the plurality of individual channels including a plurality of nozzles, respectively;

a first common channel extending in the first direction and communicating with the plurality of individual channels;

a second common channel extending in the first direction, communicating with the plurality of individual channels, wherein the first common channel and the second common channel are arranged side by side in a second direction crossing the first direction; and a connecting channel extending in the second direction and connecting an end in the first direction of the first common channel and an end in the first direction of the second common channel;

a plurality of actuators being arranged on the channel member and corresponding to the plurality of individual channels, respectively; and a temperature sensor overlapping with the connecting channel in the second direction, wherein the first common channel and the second common channel are arranged between the plurality of nozzles and the plurality of actuators in the second direction.

2. The liquid discharge head according to claim 1, wherein the channel member includes:

a nozzle surface in which the plurality of nozzles are opened, the nozzle surface crossing the second direction; and an opposite surface located opposite to the nozzle surface in the second direction, the opposite surface crossing the second direction, and wherein the temperature sensor is arranged on the opposite surface.

3. The liquid discharge head according to claim 2, wherein the plurality of actuators, are arranged on the opposite surface, and the temperature sensor is arranged on the opposite surface at a spacing distance from the plurality of actuators.

4. The liquid discharge head according to claim 2, wherein the channel member includes an interposed part which includes the opposite surface and which is interposed between the temperature sensor and the connecting channel.

5. The liquid discharge head according to claim 4, wherein the interposed part is formed of a metal.

6. The liquid discharge head according to claim 4, wherein the interposed part is formed of a silicon.

7. The liquid discharge head according to claim 4, wherein the interposed part is formed of a carbon.

8. The liquid discharge head according to claim 4, wherein the plurality of actuators are piezoelectric actuators.

9. The liquid discharge head according to claim 1, wherein each of the plurality of individual channels includes an inlet port communicating with the first common channel and an outlet port communicating with the second common channel.

10. The liquid discharge head according to claim 1, wherein a plurality of channel sets are arranged side by side in a third direction crossing the first direction and the second direction, wherein each of the plurality of individual channels set is constructed of individual channels, the first common channel, the second common channel and the connecting channel.

11. The liquid discharge head according to claim 10, wherein the temperature sensor is provided on a channel set, which is included in the plurality of channel sets and which is positioned most closely to a middle point, in the third direction, between a center in the third direction of an arrangement area of the plurality of channel sets and an end in the third direction of the arrangement area.

12. The liquid discharge head according to claim 10, wherein the plurality of channel sets includes a channel set which is positioned most closely, in the third direction, to a center, in the third direction, of an arrangement area of the plurality of channel sets, and wherein the temperature sensor is provided on the channel set.

13. The liquid discharge head according to claim 10, wherein the temperature sensor is one of a plurality of temperature sensors, and the plurality of temperature sensors are provided on the plurality of channel sets, respectively.

14. The liquid discharge head according to claim 1, further comprising:

a first channel set constructed of the plurality of individual channels, the first common channel and the second common channel; and a second channel set constructed of the plurality of individual channels, the first common channel and the second common channel, wherein the first common channel of the first channel set and the first common channel of the second channel set are arranged side by side in a third direction crossing the first direction and the second direction, the second common channel of the first channel set and the second common channel of the second channel set are arranged side by side in the third direction, the connecting channel includes a first connecting channel connecting the first common channel of the first channel set and the second common channel of the second channel set, and a second connecting channel connecting the second common channel of the first channel set and the first common channel of the second channel set, and the temperature sensor is provided on each of the first connecting channel and the second connecting channel.

* * * * *